US006357521B1

(12) United States Patent
Sugimoto et al.

(10) Patent No.: US 6,357,521 B1
(45) Date of Patent: Mar. 19, 2002

(54) HEAT EXCHANGER HAVING HEADER TANK

(75) Inventors: Tatsuo Sugimoto, Okazaki; Norihisa Sasano, Ama-gun; Satomi Muto, Nishikasugai-gun; Takaaki Sakane; Akira Uchikawa, both of Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/534,665

(22) Filed: Mar. 24, 2000

(30) Foreign Application Priority Data

Mar. 30, 1999 (JP) ..... 11-089794

(51) Int. Cl.[7] ..... F28F 9/02
(52) U.S. Cl. ..... 165/173; 165/906
(58) Field of Search ..... 165/173, 906; 29/890.052

(56) References Cited

U.S. PATENT DOCUMENTS 3,866,675 A * 2/1975 Bardon et al. ..... 165/173
5,193,613 A * 3/1993 Wallis ..... 165/173
5,492,172 A * 2/1996 Laveran et al. ..... 165/173
D373,417 S * 9/1996 Lee ..... D23/386
5,579,833 A * 12/1996 Wijkstrom ..... 165/173
6,056,047 A * 5/2000 Gowan ..... 165/174
6,167,953 B1 * 1/2001 Kobayashi et al. ..... 165/173

FOREIGN PATENT DOCUMENTS

JP U-58-154389 10/1983
JP A-10-267588 10/1998

* cited by examiner

*Primary Examiner*—Allen Flanigan
(74) *Attorney, Agent, or Firm*—Harness, Dickey & Pierce, PLC

(57) ABSTRACT

A radiator has plural metal tubes and a metal header tank. The header tank has plural connection portions each of which is connected to each of the tubes, and plural reinforcement ribs formed opposite the connection portions at a non-connection portion of the header tank to which no tube is connected. The reinforcement ribs and the connection portions are arranged in a longitudinal direction of the header tank at substantially the same pitch, so that each of the reinforcement ribs is disposed opposite each of the connection portions. Therefore, a rigidity of the non-connection portion is increased by the reinforcement ribs, and an internal pressure of the header tank is restricted from being intensively applied to the non-connection portion. As a result, a mechanical strength of the header tank is sufficiently increased without increasing a thickness of a metal plate from which the header tank is formed.

24 Claims, 12 Drawing Sheets

IXC
IXB
120f
120e
120f
120f
120f
120f
120a,120b
130

120f
120f
120f
120f
123,124
120g
130

120
130
130
130
130
INTERNAL PRESSURE

HEAT EXCHANGER HAVING HEADER TANK

CROSS REFERENCE TO RELATED APPLICATIONS

This application relates to and claims priority from Japanese Patent Application No. 11-89794 filed on Mar. 30, 1999, the contents of which are hereby incorporated by reference.

BACKGROUND OF THE INVENTION

1. Field of the Invention

The present invention relates generally to heat exchangers, and is suitably applied to a radiator which radiates heat of coolant of a water-cooled engine of a vehicle into atmospheric air.

2. Related Art

JP-U-58-154389 discloses a radiator having plural metal tubes and a header tank communicating with the tubes. The header tank is formed by connecting a metal core plate and a resin tank body by clamping. The tubes are brazed to the core plate. Recently, recycling performance of vehicle parts such as a radiator is demanded to be improved for reducing industrial waste. However, since the above-mentioned radiator is made of at least two kinds of materials including metal and resin, parts of the radiator needs to be divided into metal parts and resin parts for recycling. Therefore, the number of processes for recycling the radiator is increased, and recycling performance of the radiator is low.

SUMMARY OF THE INVENTION

As shown in FIG. 20, when a header tank 520 of a radiator (not shown) is made of only metal with a relatively small rigidity or a relatively small Young's modulus such as aluminum, the header tank 520 may not have a sufficient mechanical strength. As a result, the header tank 520 may be readily deformed by an internal pressure thereof to be expanded. Further, a connection portion of the header tank 520 to which a tube 511 is connected has a mechanical strength larger than that of a non-connection portion of the header tank 520 to which no tube 511 is connected. As a result, the non-connection portion of the header tank 520 may be intensively applied with stress and largely deformed.

Furthermore, as shown in FIG. 21, when the header tank 520 has a rectangular cross-section having a longer side ml and a shorter side m2, a longer-side wall of the header tank 520 has a larger area than a shorter-side wall of the header tank 520. Therefore, the longer-side wall is applied with a larger amount of the internal pressure of the header tank 520 than the shorter-side wall and may be largely deformed. Deformation of the header tank 520 may be restricted by increasing a thickness of a metal plate from which the header tank 520 is formed. However, in this case, a weight and a manufacturing cost of the radiator may be increased.

In view of the foregoing problems, it is an object of the present invention to provide a heat exchanger including a metal header tank having a sufficient mechanical strength without increasing a weight and a manufacturing cost of the heat exchanger.

According to the present invention, a heat exchanger has a plurality of metal tubes through which fluid flows, and a metal header tank disposed at a flow-path end of the tubes to extend in a direction perpendicular to a longitudinal direction of the tubes and to communicate with the tubes. The header tank includes first and second walls opposite each other. The first wall has a plurality of connection portions each of which is connected to each of the tubes. The second wall has a plurality of first reinforcement ribs which increase a rigidity of the header tank. The connection portions are arranged in the direction perpendicular to the longitudinal direction of the tubes at a first pitch. The first reinforcement ribs are arranged in the direction perpendicular to the longitudinal direction of the tubes at a second pitch approximately equal to the first pitch.

Therefore, a rigidity of a non-connection portion of the header tank to which no tube is connected is increased by the first reinforcement ribs, and stress is restricted from being intensively applied to the non-connection portion. As a result, a mechanical strength of the header tank is increased without increasing a thickness of a metal plate from which the header tank is formed, thereby restricting a weight and a manufacturing cost of the heat exchanger from increasing.

Preferably, the header tank is formed by connecting a first tank member and a second tank member each of which is formed by pressing to have a L-shaped cross-section so that the first and second tank members are formed using the same die.

BRIEF DESCRIPTION OF THE DRAWINGS

This and other objects and features of the present invention will become more readily apparent from a better understanding of the preferred embodiments described below with reference to the accompanying drawings, in which.

DETAILED DESCRIPTION OF THE PREFERRED EMBODIMENTS

Preferred embodiments of the present invention are described hereinafter with reference to the accompanying drawings.

(First Embodiment)

Figure 1:
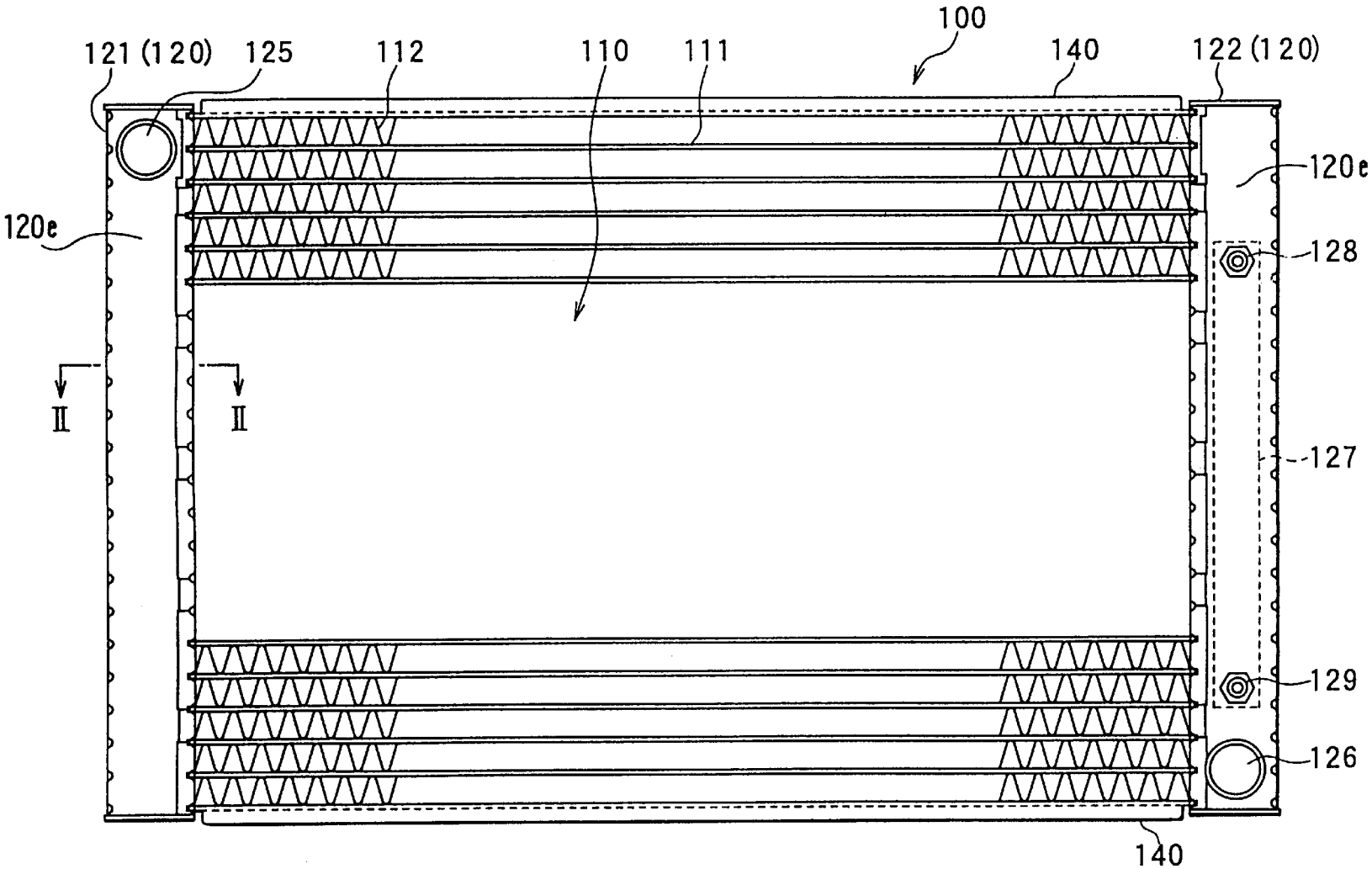
FIG. 1 is a schematic front view showing a radiator according to a first preferred embodiment of the present invention.

A first preferred embodiment of the present invention will be described with reference to FIGS. 1–5. In the first embodiment, the present invention is applied to a radiator 100 for a vehicle. In FIG. 1, the radiator 100 is viewed from an upstream air side with respect to air passing through the radiator 100. As shown in FIG. 1, the radiator 100 has plural flat tubes 111 through which coolant from an engine (not shown) of the vehicle flows. Each of the tubes 111 is formed from aluminum by extrusion or drawing. Plural aluminum corrugated fins 112 formed by a roller are disposed between adjacent tubes 111 for facilitating heat-exchange between coolant and air passing through the radiator 100. The tubes 111 and the fins 112 form a core portion 110 of the radiator 100 which cools coolant by heat-exchange between coolant and air.

The radiator 100 also includes first and second aluminum header tanks 121, 122 respectively disposed at one flow-path end (i.e., left end in FIG. 1) of the tubes 111 and the other flow-path end (i.e., right end in FIG. 1) of the tubes 111. Each of the first and second header tanks 121, 122 extends in a direction perpendicular to a longitudinal direction of the tubes 111 and communicates with the tubes 111. Coolant is introduced into the first header tank 121 through an inlet pipe 125, and is distributed into each of the tubes 111. After being heat-exchanged with air, coolant is collected into the second header tank 122, and is discharged toward the engine through an outlet pipe 126. The inlet pipe 125 is connected to a coolant outlet of the engine, and the outlet pipe 126 is connected to a coolant inlet of the engine. Hereinafter, each of the first and second header tanks 121, 122 is referred to as a header tank 120.

Figure 2:
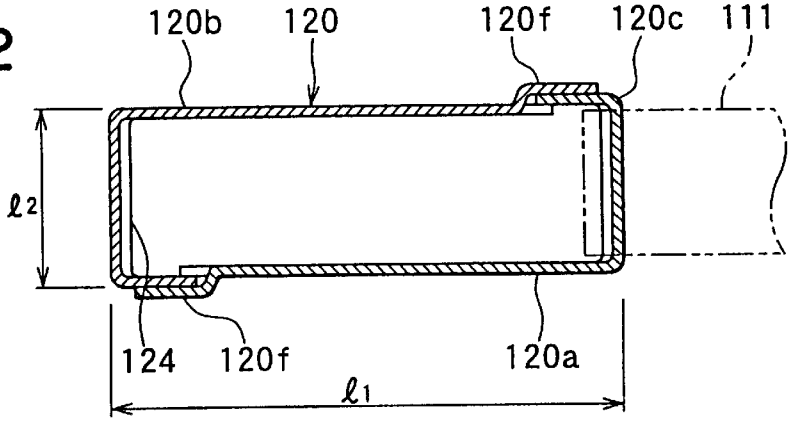
FIG. 2 is a sectional view taken along line II—II in FIG. 1.

As shown in FIG. 2, the header tank 120 has a rectangular cross-section with a longer side 11 and a shorter side 12. The longer side 11 is disposed to extend in a direction parallel with the longitudinal direction of the tubes 111, that is, in a direction perpendicular to an air-flow direction in which air passes through the radiator. In the first embodiment, the longer side 11 is set to 40 mm or more, and the shorter side 12 is set to 35 mm or less.

Figure 3A:
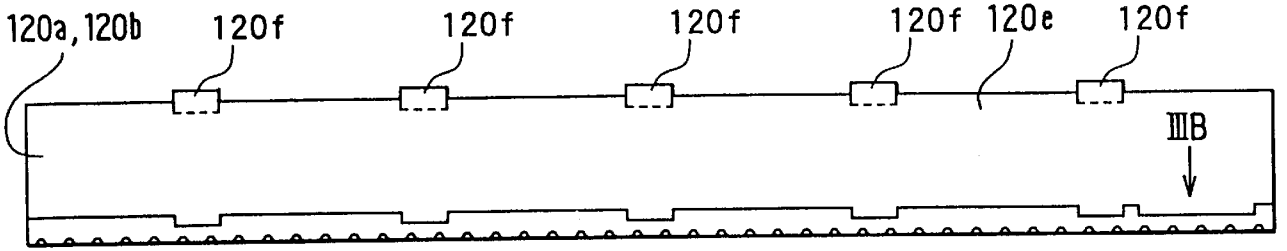
FIG. 3A is a front view showing first and second tank members of a header tank of the radiator according to the first embodiment.
Figure 3B:
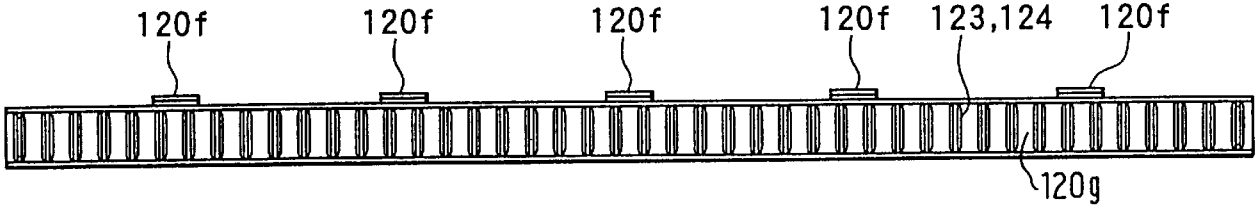
FIG. 3B is a bottom view taken from arrow IIIB in FIG. 3A.
Figure 3C:
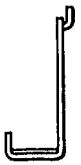
FIG. 3C is a side view taken from arrow IIIC in FIG. 3A.

As shown in FIGS. 2–3C, the header tank 120 is formed by connecting first and second tank members 120*a*, 120*b* by brazing. Each of the first and second tank members 120*a*, 120*b* is formed to have a L-shaped cross-section by pressing. As shown in FIGS. 3A–3C, each of the first and second tank members 120*a*, 120*b* has a longer-side wall 120*e* and a shorter-side wall 120*g*. The first and second tank members 120*a*, 120*b* respectively have plural first and second protruding portions 123, 124 formed on the shorter-side walls 120*g* thereof. The first and second protruding portions 123, 124 are formed to protrude inside the header tank 120 by pressing.

Figure 4:
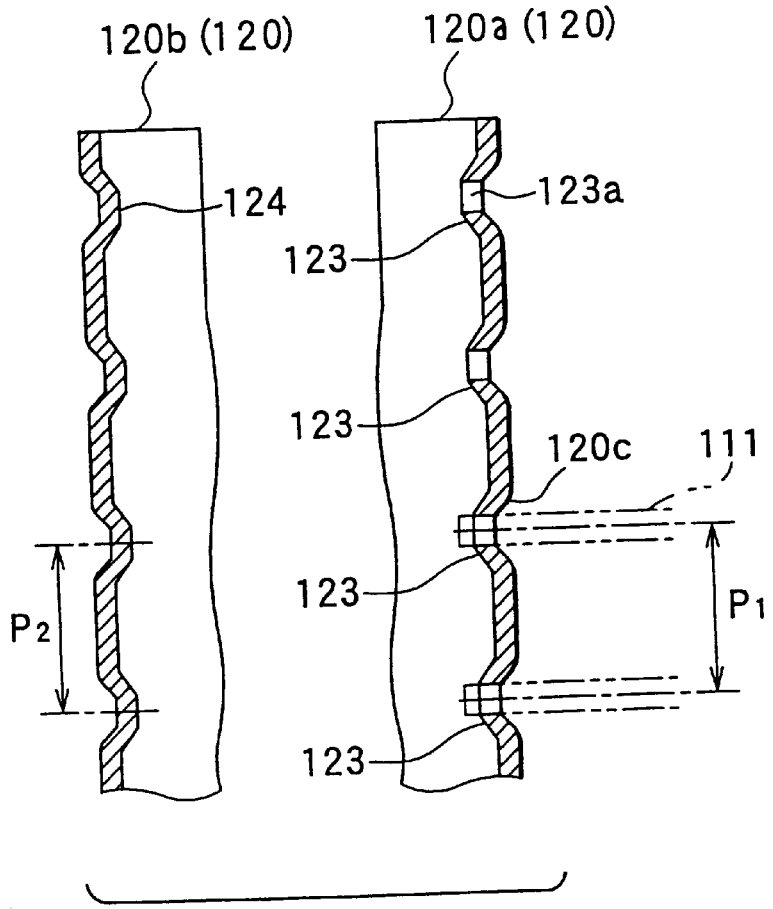
FIG. 4 is an enlarged sectional view showing the header tank according to the first embodiment.

As shown in FIG. 4, the first protruding portions 123 are arranged in the direction perpendicular to the longitudinal direction of the tubes 111 along the first tank member 120*a* at a pitch P1. The second protruding portions 124 are also arranged in the direction perpendicular to the longitudinal direction of the tubes 111 along the second tank member 120*b* at a pitch P2. The first tank member 120*a* has plural through holes 123*a* each of which is bored through a protruding end of each of the first protruding portions 123. Each of the tubes 111 is inserted into each of the through holes 123*a* and is connected to the header tank 120, thereby providing a connection portion 120*c*. Therefore, the tubes 111 are also arranged at the pitch P1 in the direction perpendicular to the longitudinal direction of the tubes 111 along the header tank 120. In the first embodiment, the first tank member 120*a* and the second tank member 120*b* have the same shape except that only the first tank member 120*a* has the through holes 123*a*. Therefore, the pitch P1 is set substantially equal to the pitch P2. As a result, when the first and second tank members 120*a*, 120*b* and the tubes 111 are brazed together to form the radiator 100, each of the second protruding portions 124 is disposed opposite each of the connection portions 120*c*, that is, each of the tubes 111.

Referring back to. FIG. 1, an oil cooler 127 is accommodated in the second header tank 122 to cool engine oil or automatic transmission fluid. The oil cooler 127 has an oil inlet 128 through which oil is introduced therein and an oil outlet 129 through which oil is discharged. A side plate 140 is disposed at each of top and bottom ends of the core portion 110 in FIG. I to extend in a direction parallel with the longitudinal direction of the tubes 111 for reinforcing the core portion 110. Further, as shown in FIGS. 2–3C, each of the first and second tank members 120*a*, 120*b* has plural clamping portions 120*f*. Each of the clamping portions 120*f* of the first tank member 120*a* clamps the second tank member 120*b*, and each of the clamping portions 120*f* of the second tank member 120*b* clamps the first tank member 120*a*, so that the first and second tank members 120*a*, 120*b* are firmly brazed together.

Figure 5:
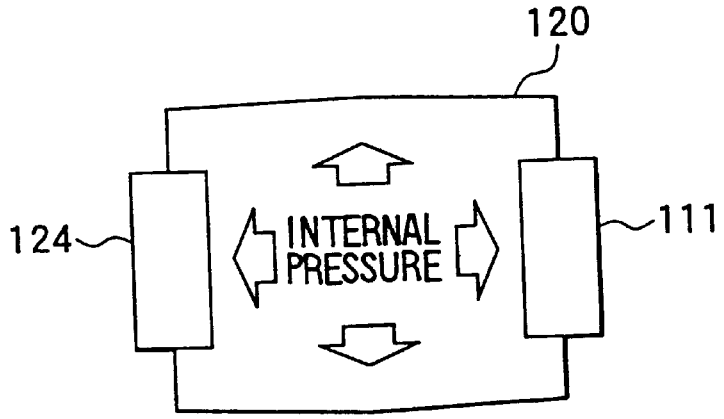
FIG. 5 is a schematic view showing an internal pressure of the header tank according to the first embodiment.

According to the first embodiment, the second protruding portions 124 are formed at a non-connection portion of the header tank 120 connected with no tube 111. The second protruding portions 124 are arranged in the direction perpendicular to the longitudinal direction of the tubes 111 along the header tank 120 at the pitch P2 substantially equal to the pitch P1 at which the connection portions 120*c* are arranged. Therefore, each of the second protruding portions 124 is disposed opposite each of the connection portions 120*c*. As a result, a rigidity of the non-connection portion of the header tank 120 is increased by the second protruding portions 124, which are also regarded as first reinforcement ribs. Therefore, as shown in FIG. 5, stress caused by an internal pressure of the header tank 120 is restricted from being intensively applied to the non-connection portion of the header tank 120. As a result, a rigidity or a mechanical strength of the header tank 120 is increased without increasing a thickness of a metal plate from which the header tank 120 is formed, and a weight and a manufacturing cost of the radiator 100 are restricted from being increased. Further, the header tank 120 can be formed from material with a relatively small rigidity or a relatively small Young's modulus such as aluminum.

Further, since the first and second tank members 120*a*, 120*b* have the same shape except that only the first tank member 120*a* has the through holes 123*a*, the first and second tank members 120*a*, 120*b* are formed by pressing using the same die in processes prior to a process in which the through holes 123*a* are formed. Therefore, investment in plant and equipment for the radiator 100 is kept low. Furthermore, since the header tank 120 is formed by two parts, i.e., the first and second tank members 120*a*, 120*b*, the oil cooler 127 is readily inserted into the header tank 120. Therefore, the number of manufacturing processes of the radiator 100 is decreased.

(Second Embodiment)

A second preferred embodiment of the present invention will be described with reference to FIGS. 6–10. In this and following embodiments, components which are substantially the same as those in previous embodiments are assigned the same reference numerals.

Figure 6:
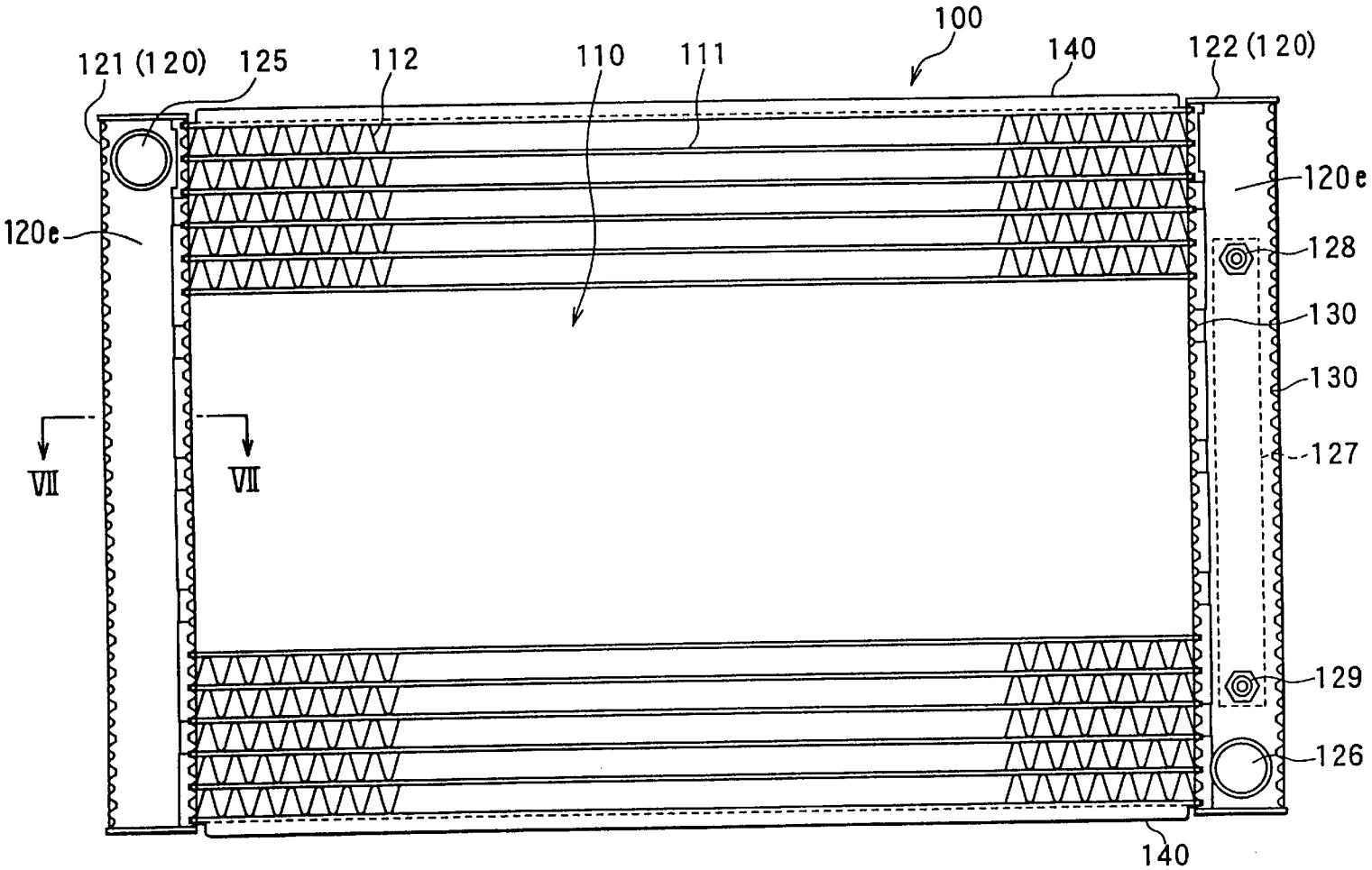
FIG. 6 is a schematic front view showing a radiator according to a second preferred embodiment of the present invention.
Figure 7:
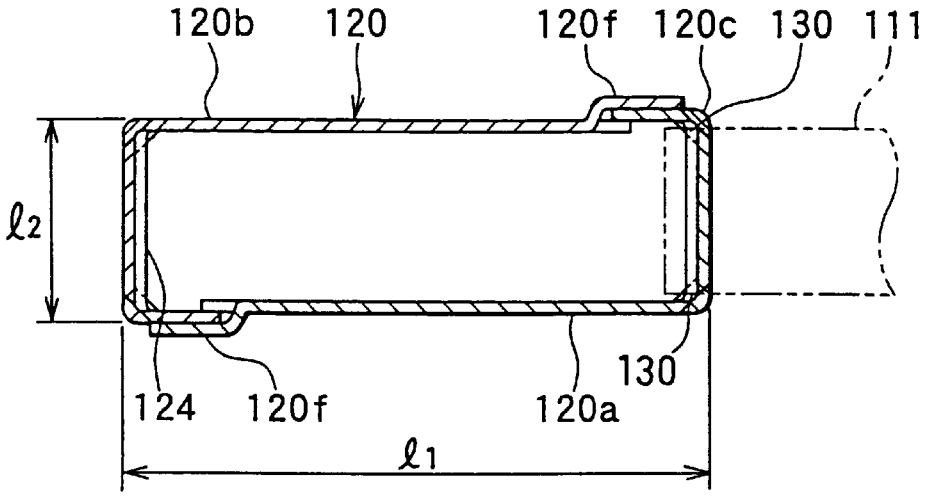
FIG. 7 is a sectional view taken along line VII—VII in FIG. 6.
Figure 8A:
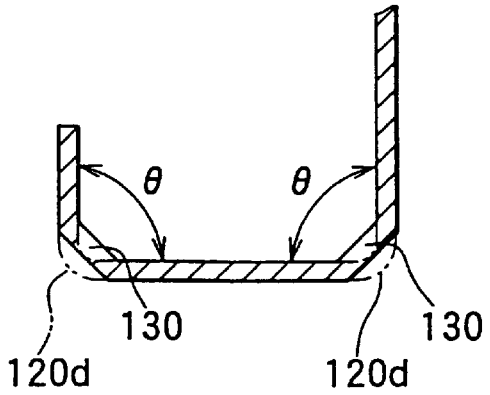
FIG. 8A is a partial sectional view showing a header tank of the radiator according to the second embodiment.
Figure 8B:
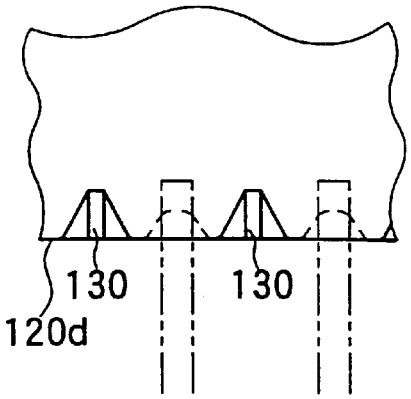
FIG. 8B is a partial side view showing the header tank according to the second embodiment.

In the second embodiment, as shown in FIG. 6, the header tank 120 has plural second reinforcement ribs 130. As shown in FIGS. 7–8B, each of the second reinforcement ribs 130 is formed by plastically deforming a part of a corner portion 120*d* of the header tank 120 to protrude inside the header tank 120. The second reinforcement ribs 130 prevent an interior angle θ of the corner portion 120*d* from increasing. As shown in FIG. 8B, each of the second reinforcement ribs 130 is formed at the corner portion 120*d* between two of the tubes 111, that is, at a position shifted from each of the tubes 111 in a longitudinal direction of the header tank 120.

Figures 9A, 9B, 9C, 10:
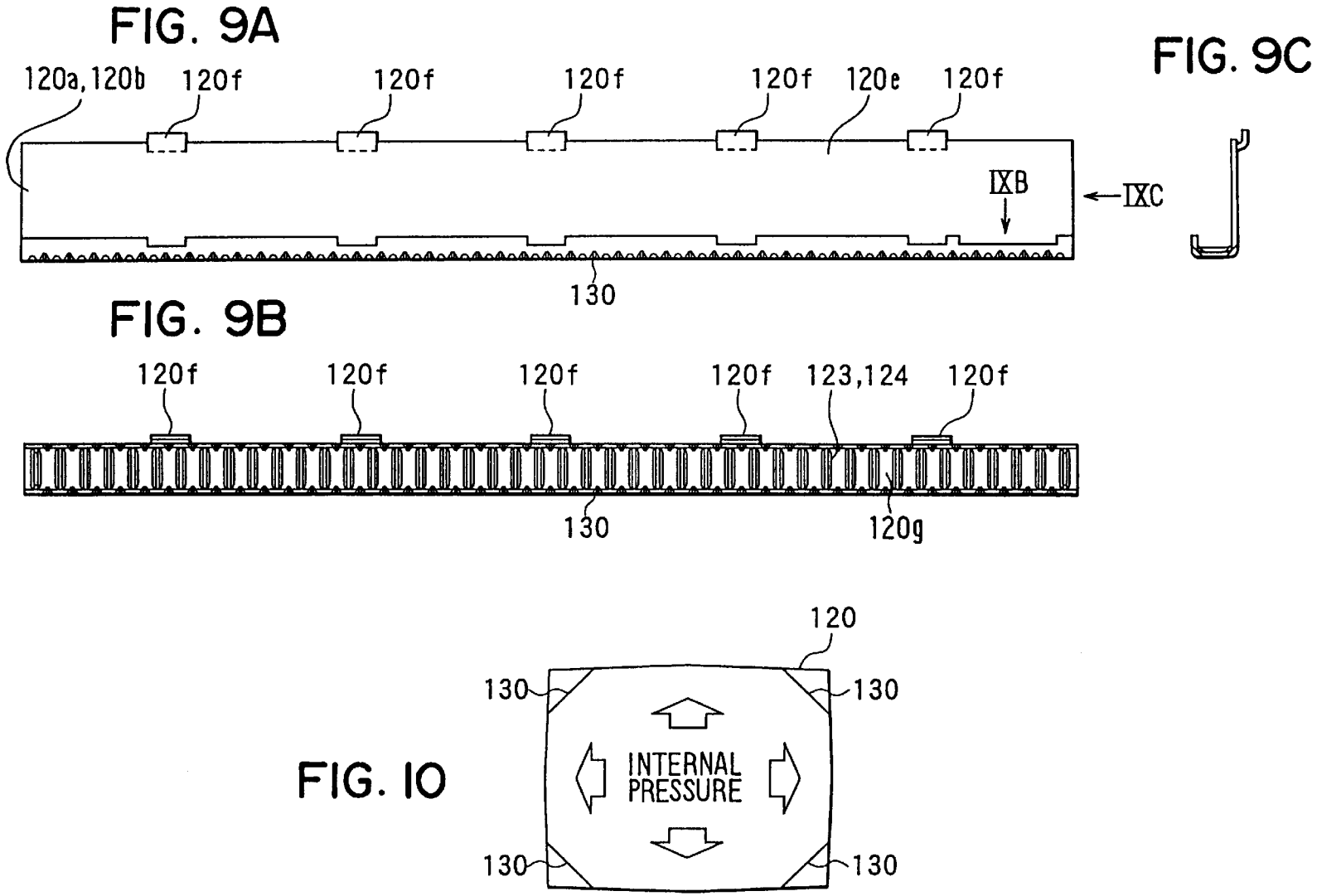
FIG. 9A is a front view showing first and second tank members of the header tank according to the second embodiment.
FIG. 9B is a bottom view taken from arrow IXB in FIG. 9A.
FIG. 9C is a side view taken from arrow IXC in FIG. 9A.
FIG. 10 is a schematic view showing an internal pressure of the header tank according to the second embodiment.

According to the second embodiment, as shown in FIG. 10, the second reinforcement ribs 130 increase a rigidity of the corner portion 120*d* to which stress tends to be intensively applied. Therefore, the mechanical strength of the header tank 120 is increased without increasing a thickness of a metal plate from which the header tank 120 is formed. As a result, a weight and a manufacturing cost of the radiator 100 are restricted from increasing. Further, similarly to the first embodiment, the first and second tank members 120*a*, 120*b* are formed by pressing using the same die in processes prior to a process in which the through holes 123*a* are formed. Therefore, investment in plant and equipment for the radiator 100 is kept low.

(Third Embodiment)

Figure 11:
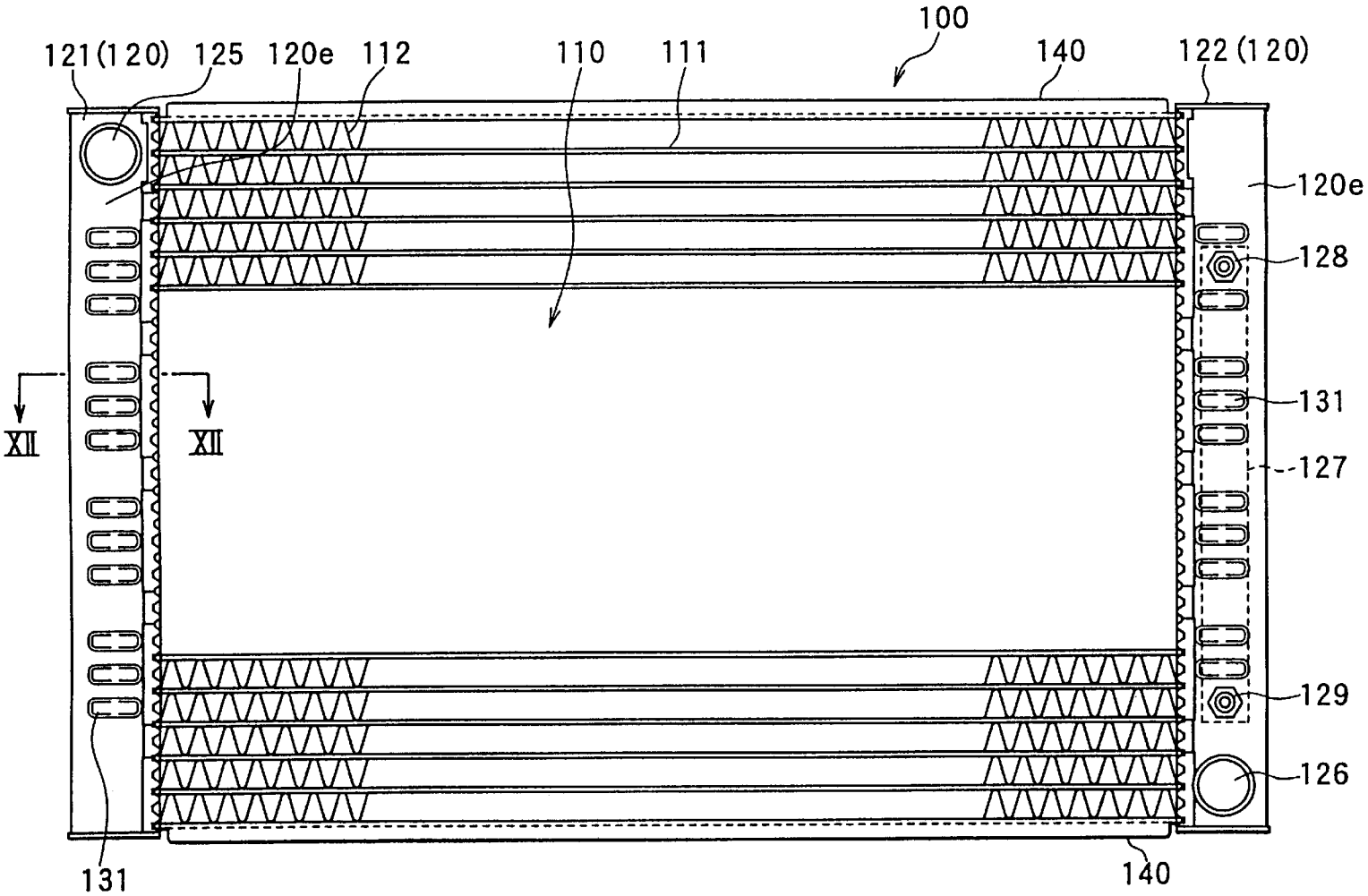
FIG. 11 is a schematic front view showing a radiator according to a third preferred embodiment of the present invention.
Figure 12:
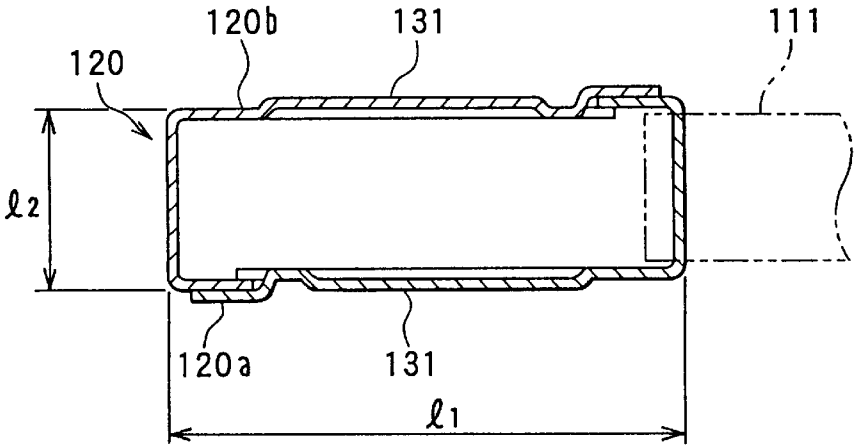
FIG. 12 is a sectional view taken along line XII—XII in FIG. 11.
Figure 13A:
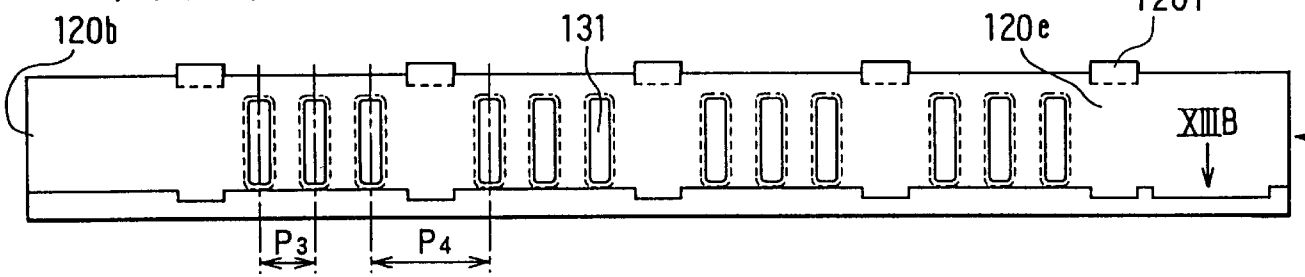
FIG. 13A is a front view showing a second tank member of a header tank of the radiator according to the third embodiment.
Figure 13C:
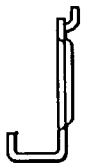
FIG. 13C is a side view taken from arrow XIIIC in FIG. 13A.
Figure 13B:
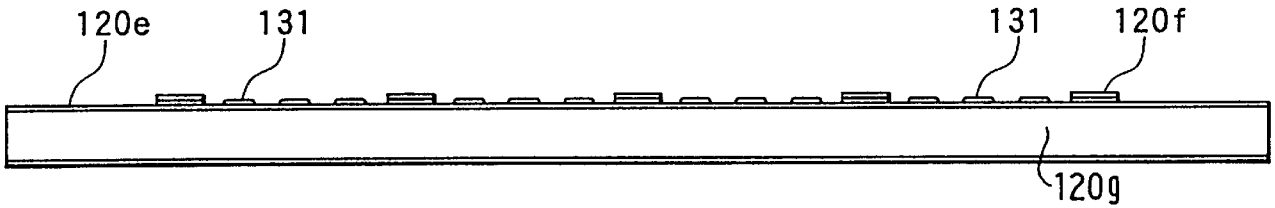
FIG. 13B is a bottom view taken from arrow XIIIB in FIG. 13A.
Figure 14:
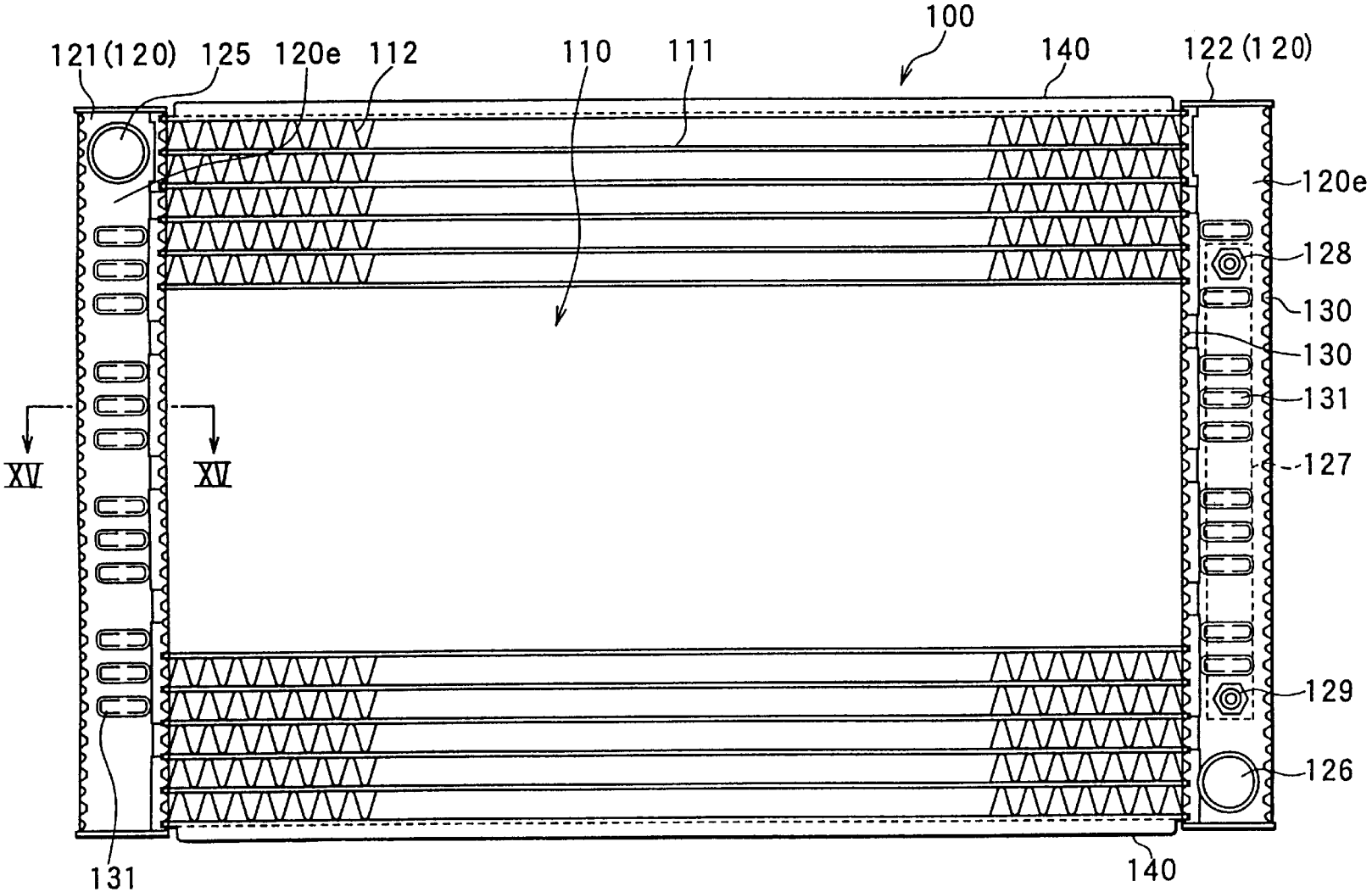
FIG. 14 is a schematic front view showing a radiator according to a fourth preferred embodiment of the present invention.

A third preferred embodiment will be described with reference to FIGS. 11–13. In the third embodiment, the longer-side wall 120*e* of the header tank 120 has plural third reinforcement ribs 131 which increase a rigidity of the longer-side wall 120*e*. The third reinforcement ribs 131 are formed to protrude outside the header tank 120. As shown in FIG. 13A, the third reinforcement ribs 131 are arranged in the direction perpendicular to the longitudinal direction of the tubes 111 along the header tank 120, and are spaced at spacings P3 or P4 each of which is an integral multiple of the pitch P1.

According to the third embodiment, since a rigidity of the longer-side wall 120*e* is increased by the third reinforcement ribs 131, the mechanical strength of the header tank 120 is increased without increasing a thickness of a metal plate from which the header tank 120 is formed. As a result, the weight and the manufacturing cost of the radiator 100 are restricted from increasing. Further, as shown in FIG. 12, each of the third reinforcement ribs 131 is formed to continuously extend from a center of the longer-side wall 120*e* to both ends of the longer side 11. Therefore, the mechanical strength of the header tank 120 is increased effectively. The center of the longer-side wall 120*e* means a center of a non-overlapped portion of the longer-side wall 120*e* in which the first and second tank members 120*a*, 120*b* are not overlapped.

When the number of the tubes 111 is increased or decreased to adjust a radiation capacity of the core portion 110, a longitudinal length of the header tank 120 may need to be changed by cutting the header tank 120 depending on the number of the tubes 111. According to the third embodiment, since each of the spacings P3 and P4 is set to an integral multiple of the pitch P1, each of the third reinforcement ribs 131 is disposed opposite any one of the tubes 111. Therefore, when the header tank 120 is cut to be reduced in length, the header tank 120 is not cut at the third reinforcement ribs 131. As a result, the header tank 120 formed using the same die can be used for a radiator core with various sizes, and the number of kinds of the die for the header tank 120 does not need to be increased. Therefore, investment in plant and equipment for the radiator 100 is kept low.

(Fourth Embodiment)

Figure 15:
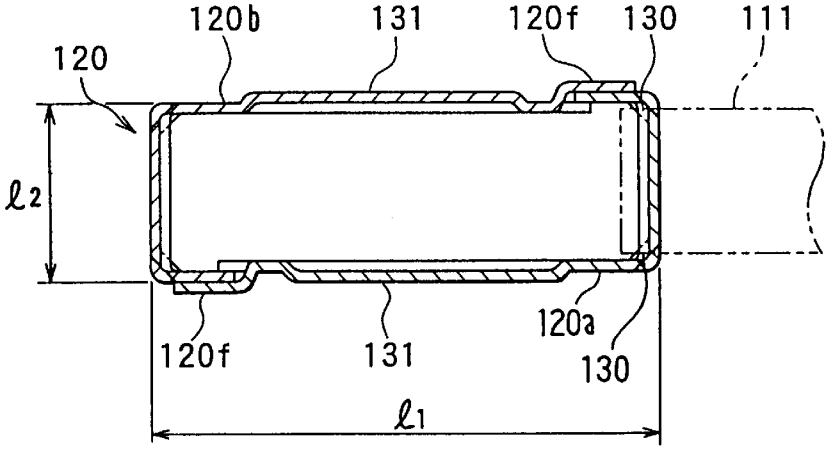
FIG. 15 is a sectional view taken along line XV—XV in FIG. 14.
Figure 16C:
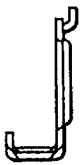
FIG. 16C is a side view taken from arrow XVIC in FIG. 16A.
Figure 16A:
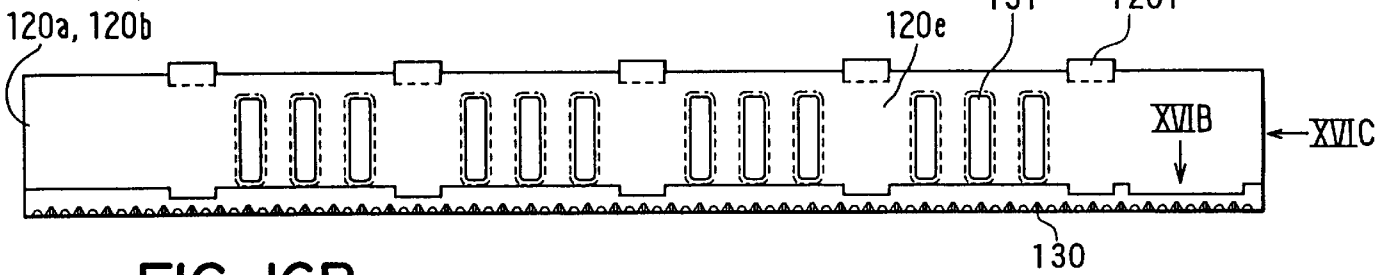
FIG. 16A is a front view showing first and second tank members of a header tank of the radiator according to the fourth embodiment.
Figure 16B:
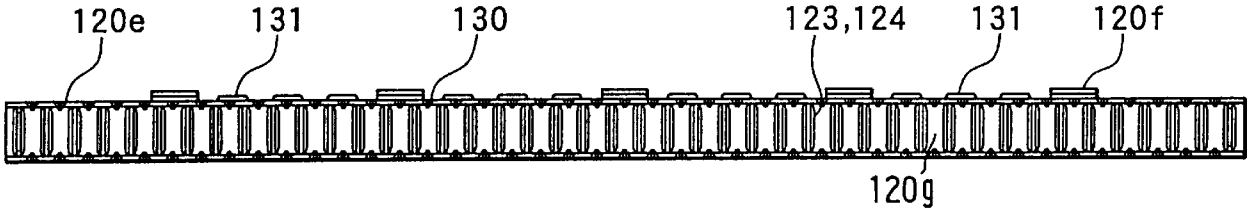
FIG. 16B is a bottom view taken from arrow XVIB in FIG. 16A.

A fourth preferred embodiment of the present invention will be described with reference to FIGS. 15–16C. The fourth embodiment is formed by combining the first through third embodiments. That is, as shown in FIGS. 15–16C, the header tank 120 has the second protruding portions 124 as the first reinforcement ribs in the first embodiment, the second reinforcement ribs 130 in the second embodiment and the third reinforcement ribs 131 in the third embodiment. According to the fourth embodiment, the mechanical strength of the header tank 120 is further increased. In the third and fourth embodiments, the present invention is effectively applied to a radiator having a header tank with a rectangular cross-section.

(Fifth Embodiment)

Figure 17:
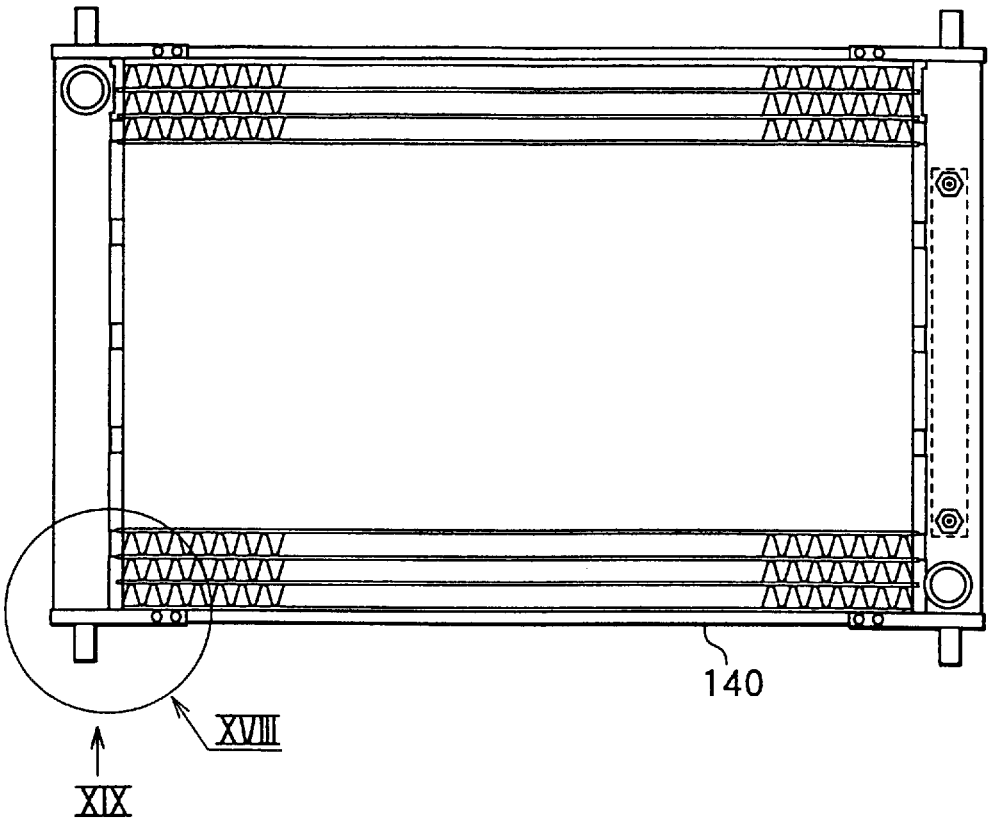
FIG. 17 is a schematic front view showing a radiator according to a fifth preferred embodiment of the present invention.
Figure 18:
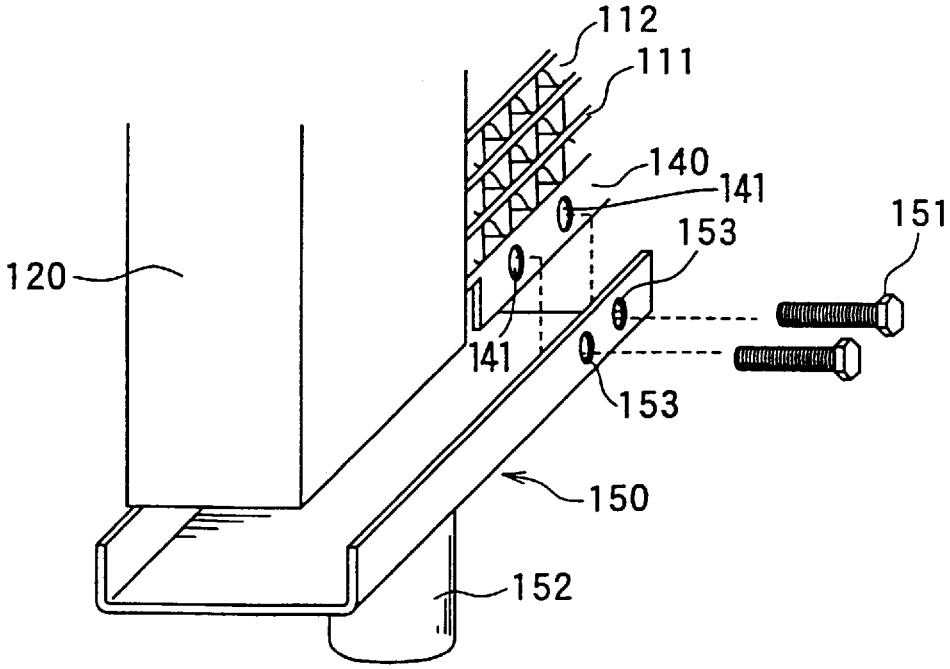
FIG. 18 is an enlarged perspective view showing a portion indicated by arrow XVIII in FIG. 17.
Figure 19:
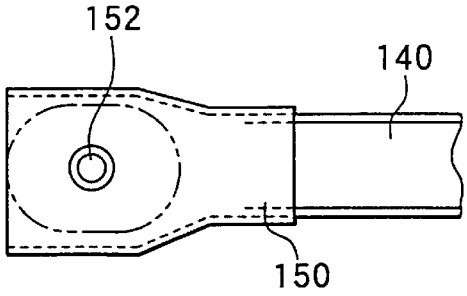
FIG. 19 is a bottom view taken from arrow XIX in FIG. 17.
Figure 20:
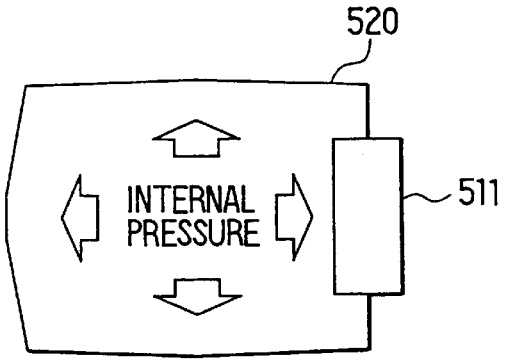
FIG. 20 is a schematic view showing deformation of a metal header tank of a radiator by an internal pressure thereof.
Figure 21:
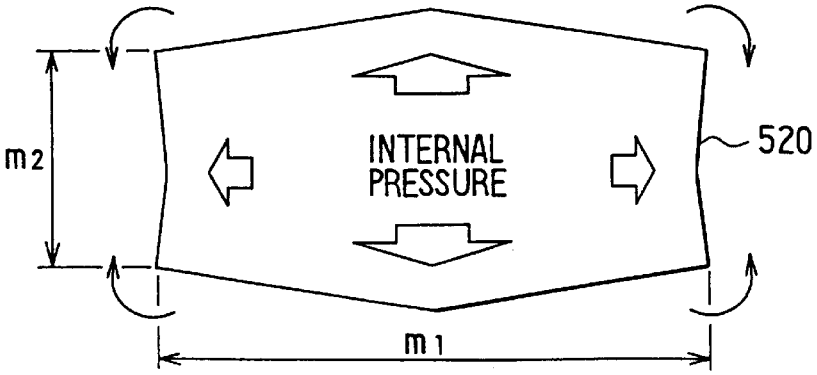
FIG. 21 is a schematic view showing deformation of a metal header tank having a rectangular cross-section of a radiator by an internal pressure thereof.

A fifth preferred embodiment of the present invention will be described with reference to FIGS. 17–19. In the fifth embodiment, as shown in FIGS. 17–19, a radiator bracket 150 through which the radiator 100 is mounted to the vehicle is fastened to the side plate 140 by bolts 151. The radiator bracket 150 has a pin 152 inserted into a vehicle bracket (not shown) attached to a vehicle, and insertion holes 153 into which the bolts 151 are respectively inserted. Each of the bolts 151 goes through each of the insertion holes 153 and each of bolt holes 141 formed in the side plate 140 and screws into a nut (not shown).

According to the fifth embodiment, even when a size of the radiator 100 is changed or an attachment position of the vehicle bracket to the vehicle is changed according to a vehicle model, the radiator 100 is readily mounted to the vehicle by replacing the radiator bracket 150. In the fifth embodiment, the radiator bracket 150 may be fastened to the side plate 140 by screws each of which is screwed into a threaded hole formed in the side plate 140. Further, the radiator bracket 150 may be brazed to the side plate 140.

In the first embodiment, the header tank 120 may have a cross-section of any shape such as a circular cross-section, instead of a rectangular cross-section. Further, the present invention may be applied to any other heat exchangers such as a condenser instead of a radiator.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat exchanger comprising:

a plurality of metal tubes through which fluid flows; and a metal header tank disposed at a flow-path end of the tubes to extend in an extending direction perpendicular to a longitudinal direction of the tubes and to communicate with the tubes, the header tank including first and second walls opposite each other, the first wall having a plurality of connection portions each of which is connected to each of the tubes, the second wall having a plurality of first reinforcement ribs which increase a rigidity of the header tank, wherein:

the header tank substantially has a rectangular cross-section, and is constructed by connecting both a first tank member and a second tank member which have approximately the same shape;

the connection portions are arranged in the direction perpendicular to the longitudinal direction of the tubes at a first pitch;

the first reinforcement ribs are arranged in the direction perpendicular to the longitudinal direction of the tubes at a second pitch approximately equal to the first pitch; and the first reinforcement ribs are provided on a surface of the second wall, opposite to the connection portions.

2. The heat exchanger according to claim 1, wherein each of the first reinforcement ribs is disposed opposite each of the connection portions.

3. The heat exchanger according to claim 1, wherein:

the header tank includes first and second longer-side walls opposite each other and first and second shorter-side walls opposite each other; and the first and second walls are the first and second shorter-side walls, respectively.

4. The heat exchanger according to claim 3, wherein the longer side of the rectangular cross-section is set to 40 mm and more and the shorter side of the rectangular cross-section is set to 35 mm and less.

5. A heat exchanger comprising:

a plurality of metal tubes through which fluid flows; and a metal header tank disposed at a flow-path end of the tubes to extend in a direction perpendicular to a longitudinal direction of the tubes and to communicate with the tubes, the header tank including first and second walls opposite each other, the first wall having a plurality of connection portions each of which is connected to each of the tubes, the second wall having a plurality of first reinforcement ribs which increase a rigidity of the header tank, wherein:

the connection portions are arranged in the direction perpendicular to the longitudinal direction of the tubes at a first pitch;

the first reinforcement ribs are arranged in the direction perpendicular to the longitudinal direction of the tubes at a second pitch approximately equal to the first pitch; and the header tank is formed by connecting a first tank member and a second tank member each of which is formed by pressing to have a L-shaped cross-section.

6. The heat exchanger according to claim 3, wherein:

any one of the first and second longer-side walls and any one of the first and second shorter-side walls cross each other to form a corner portion; and the header tank includes a second reinforcement rib disposed at the corner portion between adjacent two of the tubes in the extending direction to prevent an interior angle of the corner portion from increasing.

7. The heat exchanger according to claim 6, wherein the header tank includes a third reinforcement rib disposed in the first and second longer-side walls for increasing a rigidity of the first and second longer-side walls.

8. The heat exchanger according to claim 3, wherein the header tank includes a third reinforcement rib disposed in the first and second longer-side walls for increasing a rigidity of the first and second longer-side walls.

9. The heat exchanger according to claim 1, wherein the first reinforcement ribs protrude inside the header tank.

10. The heat exchanger according to claim 9, wherein the first reinforcement ribs are integrally formed by deforming a part of the header tank.

11. A heat exchanger comprising:

a plurality of metal tubes through which fluid flows; and a metal header tank disposed at a flow-path end of the tubes to extend in an extending direction perpendicular to a longitudinal direction of the tubes and to communicate with the tubes, the header tank including two walls crossing each other to form a corner portion, and a first reinforcement rib disposed at the corner portion between adjacent two of the tubes in the extending direction to prevent an interior angle of the corner portion from increasing, wherein:

the header tank has a rectangular cross-section, and includes first and second longer-side walls opposite to each other and first and second shorter-side walls opposite to each other;

the first longer-side wall is crossed with the second shorter-side wall by a substantial right angle in the corner portion; and the first reinforcement rib has a tilt surface connecting the first longer-side wall and the second shorter-side wall within the header tank, in an approximate triangular shape.

12. The heat exchanger according to claim 11, wherein the header tank includes a second reinforcement rib disposed on the first and second longer-side walls for increasing a rigidity of the longer-side wall.

13. The heat exchanger according to claim 11, wherein the first reinforcement rib protrudes inside the header tank.

14. The heat exchanger according to claim 13, wherein the first reinforcement rib is integrally formed in the header tank by deforming a part of the corner portion to be recessed toward inside the header tank.

15. The heat exchanger according to claim 11, wherein the corner portion extends in the direction perpendicular to the longitudinal direction of the tubes.

16. A heat exchanger comprising:

a plurality of metal tubes through which fluid flows; and a metal header tank formed to have a rectangular cross-section having a longer side and a shorter side, and including a longer-side wall and a shorter-side wall, the header tank being disposed at a flow-path end of the tubes to extend in a direction perpendicular to a longitudinal direction of the tubes and to communicate with the tubes, the longer-side wall including a reinforcement rib which increases a rigidity of the longer-side wall, wherein:

the shorter-side wall has a plurality of connection portions into which the tubes are connected;

the header tank is constructed by connecting both a first tank member and a second tank member which approximately have the same shape.

17. The heat exchanger according to claim 16, wherein the reinforcement rib protrudes outside the header tank.

18. The heat exchanger according to claim 17, wherein the reinforcement rib is integrally formed by deforming a part of the longer-side wall.

19. The heat exchanger according to claim 16, wherein:

the reinforcement rib includes a plurality of rib portions, the rib portions being arranged in the direction perpendicular to the longitudinal direction of the tubes;

the tubes are arranged in the direction perpendicular to the longitudinal direction of the tubes at a pitch;

a spacing between adjacent rib portions is an integral multiple of the pitch.

20. The heat exchanger according to claim 1, wherein each of the first tank member and the second tank member has an approximate L-shaped cross-section.

21. The heat exchanger according to claim 11, wherein the first reinforcement rib is disposed to protrude inside the header tank more than the flow-path end of the tubes.

22. The heat exchanger according to claim 11, wherein the first reinforcement rib is disposed in each corner portion defined by the first and second longer-side walls and the first and second shorter-side walls.

23. A heat exchanger comprising:

a plurality of metal tubes through which fluid flows; and a metal header tank disposed at a flow-path end of the tubes to extend in an extending direction perpendicular to a longitudinal direction of the tubes and to communicate with the tubes, the header tank having a rectangular cross-section with opposite first walls and opposite second walls, wherein:

one of the first walls has a plurality of connection portions into which the tubes are connected, the other one of the first walls has a plurality of first reinforcement ribs which increase a rigidity of the header tank;

the connection portions are arranged in the direction perpendicular to the longitudinal direction of the tubes at a first pitch;

the first reinforcement ribs are arranged in the direction perpendicular to the longitudinal direction of the tubes at a second pitch approximately equal to the first pitch; and the header tank includes a second reinforcement rib provided on the second walls, for increasing a rigidity of the second walls.

24. The heat exchanger according to claim 23, wherein each length of the second walls is longer than that of the first walls.

* * * * *